US005461831A

United States Patent [19]

Michal

[11] Patent Number: 5,461,831

[45] Date of Patent: Oct. 31, 1995

[54] ASSEMBLAGE AND METHOD FOR RELIEVING OVERPRESSURE IN AN ENCLOSURE

[75] Inventor: Vratislav M. Michal, Rochester, N.Y.

[73] Assignee: Eastman Kodak Company, Rochester, N.Y.

[21] Appl. No.: 175,039

[22] Filed: Dec. 29, 1993

[51] Int. Cl.[6] ..... E04B 1/98

[52] U.S. Cl. ..... 52/1; 52/202; 52/DIG. 4; 49/478.1; 220/230; 220/203.01; 220/89.1

[58] Field of Search ..... 49/478.1; 52/1, 52/200, 202, 573.1, DIG. 4; 220/89.1, 89.2, 203, 207, 208, 209, 230

[56] References Cited

U.S. PATENT DOCUMENTS

| | | | |
|---|---|---|---|
| 2,958,912 | 11/1960 | Bower et al. | 49/478.1 |
| 3,048,902 | 8/1962 | Hastings et al. | 49/478.1 X |
| 3,111,728 | 11/1963 | Alderfer | 52/DIG. 4 X |
| 3,167,931 | 2/1965 | Bryson | 220/203 X |
| 3,882,637 | 5/1975 | Lindenschmidt | 52/DIG. 4 X |
| 4,387,541 | 6/1983 | Boomershine | 52/202 |
| 4,409,758 | 10/1983 | Dickerson et al. | 52/202 X |
| 4,454,686 | 6/1984 | Stapenell | 49/394 X |
| 5,271,189 | 12/1993 | Vincent et al. | 52/1 |

FOREIGN PATENT DOCUMENTS

| | | | |
|---|---|---|---|
| 625008 | 8/1978 | U.S.S.R. | 52/1 |

*Primary Examiner*—Carl D. Friedman
*Assistant Examiner*—Kevin D. Wilkens
*Attorney, Agent, or Firm*—Susan L. Parulski

[57] ABSTRACT

An assemblage (10) for relieving overpressure in an enclosure (12) has a first panel (14) configured to surround an opening (13) in the enclosure (12), The first panel (14) comprises an outer skin (19) and a thermal barrier layer (15) for providing insulation during normal operation, A gasket member (24) is bonded to the thermal barrier layer (15) between panel edges (22). The gasket member (24) includes a magnetic portion (26) comprising magnets (23) encased in outer layer (16) for releaseably sealing the first panel (14) to the enclosure (12) and a bellows portion (28) for accommodating movements in the first panel (14) during thermal expansion.

10 Claims, 3 Drawing Sheets

ASSEMBLAGE AND METHOD FOR RELIEVING OVERPRESSURE IN AN ENCLOSURE

FIELD OF THE INVENTION

The invention relates to an assemblage and method for relieving overpressure. More particularly, the invention concerns an assemblage and method for relieving overpressure or pressure buildup in a machine processing enclosure following a deflagration, so as to avoid damage to the enclosure and equipment therein.

BACKGROUND OF THE INVENTION

In machine processing areas having a volatile atmosphere, such as film fabrication, means of venting in the event of a deflagration is generally provided, thus preventing damage to the machine itself. Fabrication of solvent based film involves casting a liquid dopant onto a polished surface, such as a stainless steel band or a wheel to produce the film. The film is then stripped from the polished surface in order to remove the solvents from the film prior to winding the film in roll form. To prevent solvent emissions and to permit recovery of the solvent, the equipment is contained within a sealed, insulating casing. Explosion panels are generally provided to relieve the pressure with the casing in the event of an explosion. Research Disclosure No. 35518, dated November 1993, describes one such panel constructed of a frame incorporating several layers of a clear film. The layers of a film such as polyester are used to provide thermal insulation and reduce inertia of the panel. The panels are attached to the casing or enclosure by capturing the periphery of the frame at one of the layers of film between an annular metal frame surrounding the opening of the casing and a continuous annular magnet. When a pressure wave occurs due to an explosion, the periphery pulls out from between the magnet and the frame surrounding the opening of the casing and the panel is pushed outside of the casing. Low pressure (½ to ¾ psi) release venting is achievable with the above described panel.

U.S. Pat. No. 4,777,974, issued Oct. 18, 1988 to Swift et al., discloses a pressure relief panel assembly for rupture disks, explosion vents and the like characterized by predetermined weaknesses in a plurality of panel portions which burst at different pressures.

U.S. Pat. No. 3,250,206, issued May 10, 1966 to Strouth, discloses a ventilation system for a building roof that includes a magnetic element incorporated in a frame for securement to the building.

U.S. Pat. No. 3,182,855, issued Oct. 18, 1962 to Stock, discloses a blow-out door adhesively bonded to a fluid containing shell structure for overpressure protection.

Other types of venting panels are described in, for instance, U.S. Pat. No. 4,498,261 directed to a vent panel comprising a sealing membrane bonded to the panel; and, U.S. Pat. No. 3,189,675 related to a pressure relief device for relieving sealed electrical devices from internal pressure.

Thus, means of accomplishing overpressure venting generally includes an opening in the machine enclosure sized relative to the volume of the enclosure and a cover for the opening. Under rather rigid fire regulations, promulgated by the National Fire Prevention Association (NFPA), the panel must meet specific requirements to be considered in compliance with standards, some of which are enumerated below. (See NFPA 68, entitled *Guide for Venting Deflagrations,* page 15, 1988 ed.). According to NFPA, the panel must be designed, constructed, installed and maintained so that it will readily release and move out of the path of the combustion gases. The panel must also not become a missile hazard when it operates.

Further, according to NFPA, the total weight of the panel assembly, including any insulation and permanently mounted hardware, should be as low as practical, but in no case should it exceed 2.5 lbs per sq. ft. The purpose of this limitation is to keep the inertia of the assembly as low as possible, so that the vent opens as rapidly as possible.

Moreover, as indicated by NFPA, the material construction of the panel should be suitable for the environment to which it will be exposed. Brittle materials will fragment, producing potentially lethal missiles. Some panels because of their configuration, may travel some distance from the enclosure. Each installation must be evaluated to determine the extent of hazard to personnel from such missiles.

Furthermore, according to the NFPA, the vent panels must release at as low an internal pressure as practical, yet stay in place when subjected to external wind forces. Also, the panel must provide the required vent area for the volume of the enclosure being protected. The panel, moreover, must not release at pressures which are normally experienced during normal operations.

Since it is required that the panel be as light weight as possible, the regulations imposing only an upper limit, many designs of vent panels employ membranes, such as aluminum or plastic sheet stock (see for example U.S. Pat. No. 4,498,261). One way known to retain the membrane to the enclosure includes the use of magnets having a holding force such that under a specific enclosure pressure the membrane is pulled from under the magnets, or the magnets separate from the machine enclosure, and free the membrane. Another known way to retain the membrane to the enclosure is by the use of a spring loaded frame. In this case, the spring force is sized so that the membrane is pulled from under frame when a specified pressure is reached. Yet another way to retain the membrane on the enclosure is by clamping it to the machine frame having serrated edges. In this case, when the overpressure in the enclosure urges the membrane onto the edges of the serration, the membrane is cut free from the enclosure.

Although specific disadvantages and advantages are associated with each of these prior art designs or configurations, the membrane type vent panel, as discussed above, has many shortcomings including poor thermal characteristics, i.e., the panel transmits heat in and out of the enclosure during normal operations, and susceptibility to causing injury. Also, the membrane type panel does not provide suitable access to the interior of the enclosure.

It is known that a rigid panel may address some of the above disadvantages, especially those related to poor insulating characteristics. However, rigid panels tend to exceed the regulations weight requirements. While some recently developed light weight plastic materials may offer new opportunities to deal with the weight problem, these materials often raise issues of chemical compatibility and distortion due to thermal expansion, i.e., changes in temperature of the enclosure during normal operations.

Other conventional means of securing such a vent panel to an enclosure having the capability of releasing the panel when a certain pressure within machine enclosure is reached, include: shear bolts or similar elements, and mechanical latches designed to release under a certain load.

The shear bolt/element method has the advantage of simplicity, but makes impractical the use of such a vent panel as a means of providing access to the interior of the enclosure. Also, the release force is dependent upon the actual strength characteristics of the material. This may vary over a wide range for a given type of material. The actual release force of this design cannot be verified.

A significant disadvantage of the mechanical design latch is that it is complex and needs to be adjusted for a specific application. The adjustment cannot be readily calibrated and is not tamper resistant. Moreover, the latch function may be affected by dirt.

SUMMARY OF THE INVENTION

It is, therefore, the object of the invention to overcome the shortcomings of the prior art. Accordingly, for accomplishing these and other objects of the invention, there is provided an assemblage for relieving overpressure in an enclosure comprising a first panel configured to surround an opening in the enclosure. The first panel comprises a thermal barrier layer for providing insulation during normal operation. A gasket member having a base flange is sealed to the thermal barrier layer adjacent to panel edges of the first panel. The gasket member also comprises a bellows portion for accommodating movement of the first panel during thermal expansion. Moreover, the gasket member includes a magnetic portion for providing a releasable seal to the enclosure surrounding the opening.

Another solution to one or more of the above problems is provided by a method of relieving overpressure in an enclosure. The method comprises the steps of providing the assemblage described above, and mounting the first panel of the assemblage to the enclosure surrounding the opening so that the magnetic portion of the first panel seals around the opening and releases the first panel in response to overpressure.

Advantageous effects of the assemblage and method of the invention include: simplicity of construction, light weight, inexpensive to manufacture, and predictable and reliable performance. Moreover, the assemblage of the invention does not require calibration of holding force because of the permanent nature of the magnetic portion used to form a releasable seal between the assemblage and the enclosure.

BRIEF DESCRIPTION OF THE DRAWINGS

The foregoing as well as other objects, features and advantages of this invention will become more apparent from the appended Figures, wherein like reference numerals denote like elements, and wherein.

DETAILED DESCRIPTION OF THE INVENTION

Figure 1:
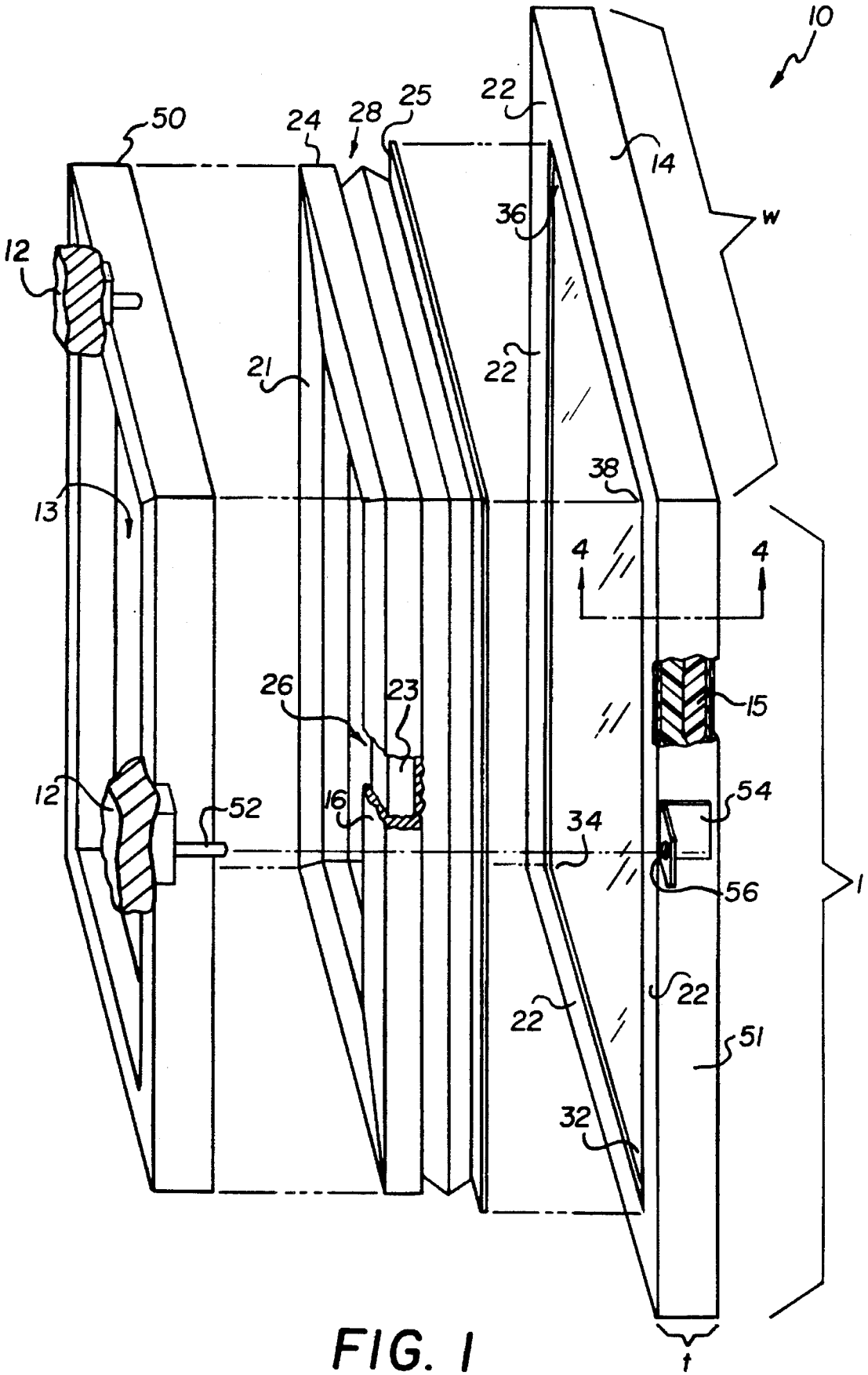
FIG. 1 is an exploded perspective view of the assemblage of the invention, partially broken away to expose a magnetic portion of the gasket member.
Figure 2:
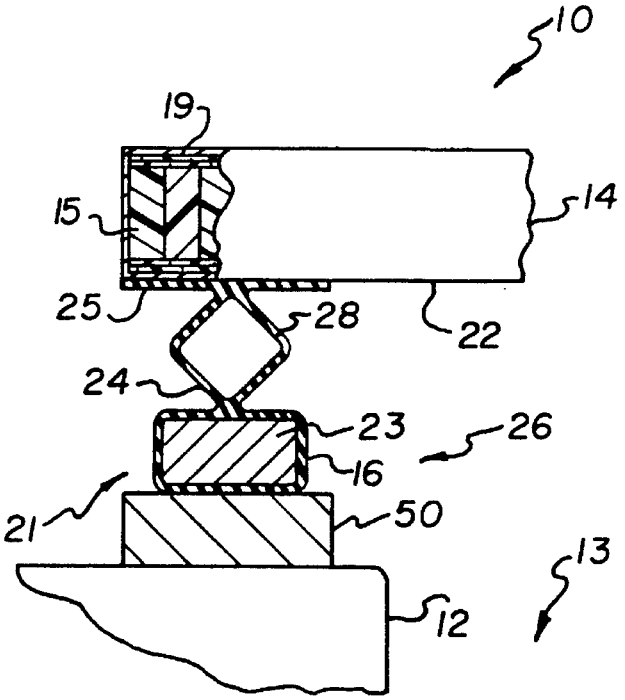
FIG. 2 is a cross section view of the assemblage of the invention.
Figure 5:
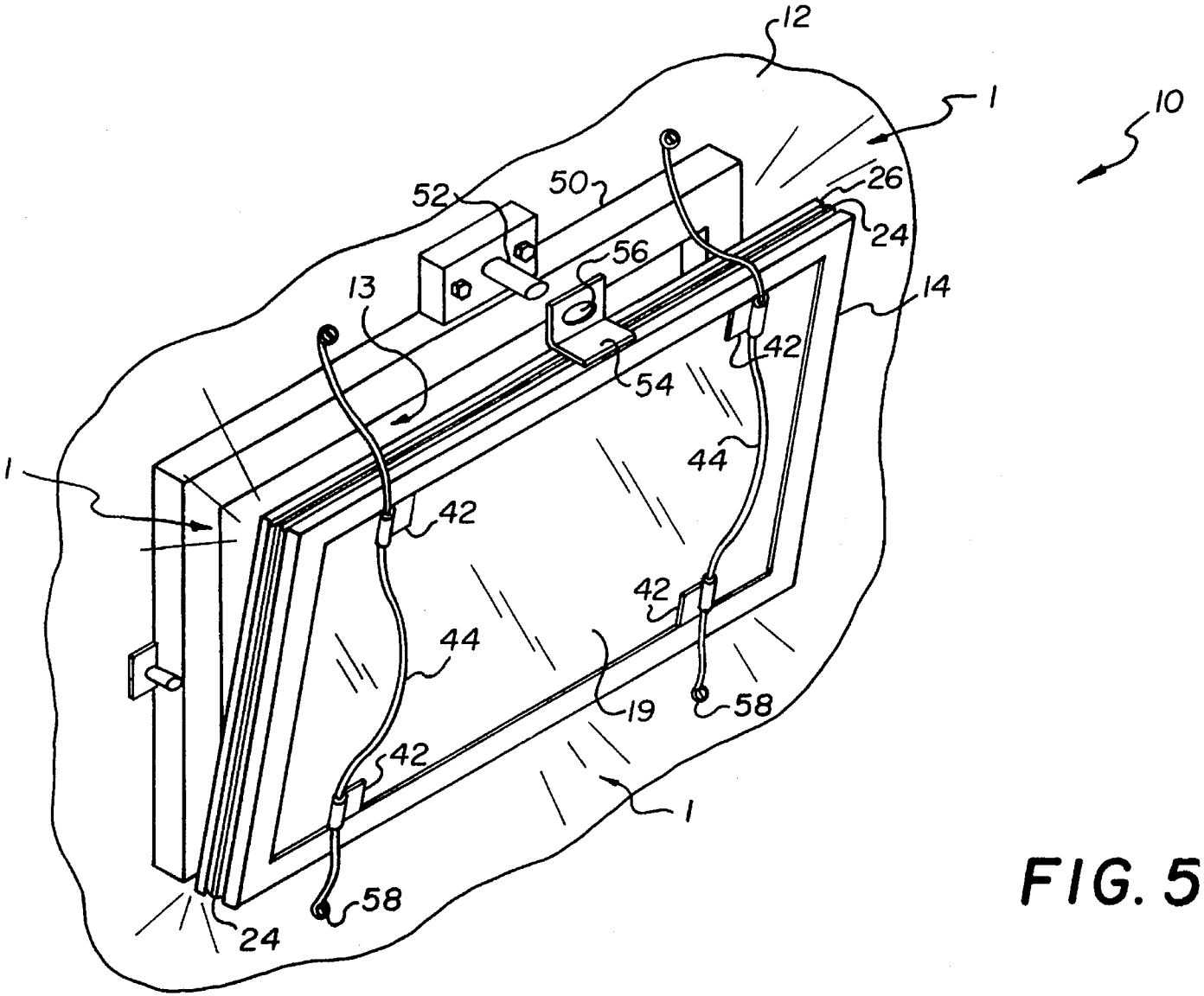
FIG. 5 is a perspective view of the assemblage ejected from the enclosure under overpressure but restrained by a paired of tethers.

Turning now to the drawings, and more particular to FIGS. 1, 2 and 5, the assemblage 10 of the invention for relieving overpressure or pressure buildup in an enclosure 12 having an opening 13 is illustrated. Broadly defined, the assemblage 10 comprises a first panel 14 configured to surround the opening 13 in the enclosure 12, described in detail below. Preferably first panel 14 is substantially rectangular shaped to conform with a substantially rectangular shaped opening 13 in the enclosure 12. First panel 14 also comprises a thermal barrier layer 15 (described below) for providing thermal insulation during normal operation, best seen in FIGS. 1 and 2. According to FIG. 1, first panel 14 is provided with a plurality of panel edges 22 and the thermal barrier layer 15 interposed therebetween and adjacent to the panel edges 22. According to FIG. 2, base flange 25 of gasket member 24 is bonded to the thermal barrier layer 15 with an adhesive material compatible with the environment, and the assemblage 10 is then releaseably mounted onto the enclosure 12 surrounding the opening 13. A preferred adhesive material is Epoxy 907 from Miller Stapleson Chemical Co., George Washington Highway, Dansbury, Conn. Opposite flange 25, gasket member 24 includes a magnetic portion 26 comprising a magnet 23 encased in gasket member 24, and spaced from flange 25 by bellows shaped portion 28. A releasable seal between the enclosure 12 and the assemblage 10 is formed by the magnetic attraction between magnetic portion 26 compressing against the enclosure 12 or optional second panel 50 surrounding the opening 13 of the enclosure 12.

In FIG. 2, base flange 25 of gasket member 24 is depicted adhered to thermal barrier layer 15 adjacent to panel edges 22. In the preferred embodiment, gasket member 24 is made of a fluorosilicone extruded material. However, those skilled in the art will appreciate that other materials, such as VITON™ made by DuPont de Nemour, Polymer Products Dept., Elastomer Div., Wilmington, Del., may be used. As indicated above, gasket member 24 is adhesively bonded to thermal barrier layer 15 in first panel 14 (FIG. 1). In the preferred embodiment, the magnetic portion 26 comprises gasket skin layer 16 (FIGS. 1–3) encasing elongated strips of permanent magnets 23 which are joined at the corners 32,34,36,38 of thermal barrier layer 15 adjacent to the panel edges 22. To ensure that the magnetic portion 26 will hold and then release under overpressure, the skin layer 16 in the forward portion 21 of gasket member 24 contacting the enclosure 12, or alternatively the second panel 50 surrounding the opening 13 of the enclosure 12, has a thickness sized so that the magnetic field strength therebetween provides a minimum threshold holding force, defined approximately by the equation:

$$F_{mf}=P_{int}\times A_v$$

where $F_{mf}$ is the minimum threshold holding force;

$P_{int}$ is the maximum normal operating pressure of the enclosure (psi or kPa); and, $A_v$ is the effective area of first panel 14 (Ft. $^2$ or $m^2$), i.e., the area defined by the space between panel edges 22.

Figure 3:
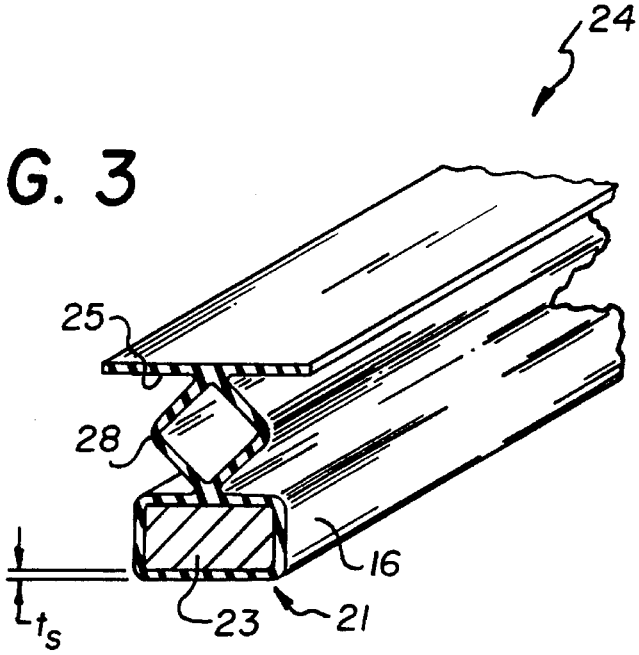
FIG. 3 is an enlarged fragmentary sectional view of the gasket of the invention.

For the purpose of the present invention, the inventor has determined that a preferred minimum threshold holding force $F_{mf}$ for assemblage 10 is about 5 lbs per square ft. This threshold holding force is achieved with a skin thickness ($t_s$) in the forward portion 21 of gasket member 24 about 0.017 inches (0.0488 cm) to about 0.025 inches (0.0635 cm) (FIG. 3).

Figure 4:
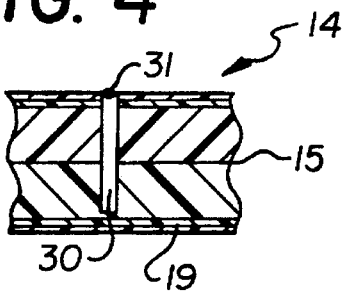
FIG. 4 is a section view taken along line 4—4 of FIG. 1.

Further, the bellows shaped portion 28 of gasket member 24 accommodates warping of first panel 14 due to temperature changes or gradients during normal operations, and any distortions in the degree of flatness of the second panel 50 surrounding the opening 13 in the enclosure 12. Moreover, in an alternative embodiment (FIG. 4), first panel 14 comprises at least one groove 30 formed on an inside portion of the first panel 14 rearwardly of the enclosure 12 when mounted thereon. Groove 30 extends from an edge portion 31 to partially along the width of thermal layer 15, thus reducing the effective size of first panel 14, thereby providing an additional means of reducing movement, such as deflections of first panel 14 caused by thermal expansion, during normal operations. Moreover, groove 30 is sealed at the edge portion 31 with a flexible epoxy material compatible with the environment, such as Epoxy 907 described above. The deflection of first panel 14 is a function of thickness and size. Groove 30 effectively makes first panel 14 behave like a number of smaller panels, thereby reducing the amount of deflection that must be accommodated by bellows 28 of gasket 24.

Referring again to FIGS. 1 and 2, magnetic portion 26 comprises molded magnetic bars 23. The filler material of magnets 23, although not directly exposed to the process environment, is compatible with its chemical composition and temperature. Magnets 23 are preferably made of a rare earth material and magnetized to yield a magnetic field strength that meets or exceeds regulatory holding force requirements for the entire size of assemblage 10. In the preferred embodiment, as depicted in FIG. 1, the assemblage 10 has a width (w) of 30 inches (76.2 cm); a length of 50 inches (127 cm); and, a thickness (t) of 0.875 inches (2.22 cm); and, magnetic portion 26 has a holding force of about 0.4 lbs/in.

As depicted in FIGS. 1, 2 and 5, in the preferred embodiment of the invention, optional second panel 50, preferably comprising a ferrous metallic material, is bolted around the opening 13 of the machine enclosure 12. A compressible gasket (not shown) of suitable material is also seated between the second panel 50 and the machine enclosure 12 for providing a seal. In addition to the second panel 50 being precision machined to provide sufficient finish and flatness, the second panel 50 is equipped with a number of jack screws (not shown) for leveling and guide pins 52 for providing a variety of functions. Guide pins 52 provide a convenient means of installing the assemblage 10. As shown in FIG. 1, bracket 54 having an oversized through opening 56 for receiving the guide pin 52 is affixed in registered alignment with guide pin 52 on exterior sidewall 51 of first panel 14. Those skilled in the art will appreciate that more than one guide pin 52 and aligned bracket 54 arrangement can be used within the requirements of the invention. If it is desired to mount assemblage 10 vertically onto the enclosure 12, the guide pins 52 will support the weight of assemblage 10 so that its weight is not entirely supported by the seal formed by gasket member 24. Assemblage 10, in an alternative embodiment, comprises cable retainer 42 for cable restraints 44 that inhibit assemblage 10 from uncontrollable flight in response to deflagration overpressure. Cable restraints 44 are anchored to enclosure 12 or optionally second panel 50 with, for instance, screws 58.

Turning again to FIGS. 1, 2 and 4, first panel 14 comprises a thermal barrier layer 15 for providing insulation during normal operation and an outer skin 19. Preferably, insulating layer 15 comprises a honeycomb type material, such as HRM™ 78 ¼–3.0 Nomex Honeycomb Core made by Hexcel Corporation of Bethel, Conn. 06801. The preferred first panel 14 used in assemblage 10 having the above characteristics is HEXGARD I™, type I made by Hexcel Corporation. Moreover, the construction and sizing of first panel 14 are such that a balance is maintained between the requirements of maximum allowable surface temperature, the capability of gasket member 24 to accommodate non-uniformities in flatness of first panel 14, and total assemblage 10 inertia mass goal of less than about 2.5 lbs/ft. sq.

In another embodiment of the invention, a method of relieving overpressure in an enclosure having an opening comprises the step of providing the assemblage 10 described above. The assemblage 10 is then releaseably sealed around the opening 13 so that said magnetic portion 26 of the first panel 14 seals the opening 13, and releases the first panel 14 in response to overpressure.

In yet another embodiment of the invention, the assemblage 10 can be made in form of hinged doors (not shown), preferably double hinged, to accommodate assemblage 10 use as a means of providing access into the enclosure 12.

While the invention has been described with a certain degree of particularity it is manifest that many changes may be made in the details of construction and the arrangement of components without departing from the spirit and scope of the disclosure. It is understood that the invention is not limited to the embodiments set forth herein for purposes of exemplification, but is to be limited only by the scope of the attached claim or claims, including the full range of equivalency to which each element thereof is entitled.

| | Parts List |
|---|---|
| Assemblage | 10 |
| Enclosure | 12 |
| Opening | 13 |
| First panel | 14 |
| Barrier Layer | 15 |
| Gasket skin layer | 16 |
| Outer panel Skin | 19 |
| Forward Portion of Gasket | 21 |
| Panel Edges | 22 |
| Magnets | 23 |
| Gasket Member | 24 |
| Base Flange | 25 |
| Magnetic Portion | 26 |
| Bellows-Shaped Portion | 28 |
| Groove | 30 |
| Corners | 32,34,36,38 |
| Anchoring Means | 42 |
| Cable Restraints | 44 |
| Second panel | 50 |
| Exterior Sidewall | 51 |
| Guide Pins | 52 |
| Brackets | 54 |
| Recess Portion | 56 |
| Screws | 58 |

What is claimed is:

1. An assemblage for relieving overpressure in an enclosure having an opening, said assemblage comprising:

a first panel configured to surround an exterior side of said opening, said first panel comprising a thermal barrier layer bonded therein for providing thermal insulation during normal operation, and panel edges surrounding said thermal barrier layer, said first panel comprising means for at least partially reducing movement of said first panel during thermal expansion, said means including at least one groove extending from an edge portion inside said first panel and terminating partially along the width of the thermal barrier layer, said groove being positioned rearwardly of said enclosure when mounted thereon; and, a gasket member having a base flange for bonding to said thermal barrier layer, said gasket member comprising a bellows shaped portion for accommodating movements of said first panel during thermal expansion and a magnetic portion for providing a releasable seal between said bellows portion and said enclosure.

2. An assemblage for relieving overpressure in an enclosure having an opening, said assemblage comprising:

a first panel configured to surround an exterior side of said opening, said first panel comprising a thermal barrier layer bonded therein for providing thermal insulation during normal operation, and panel edges surrounding said thermal barrier layer, said first panel attached to a second panel surrounding said opening of the enclosure, said second panel being bolted to the enclosure; and a gasket member having a base flange for bonding to said thermal barrier layer, said gasket member comprising a bellows shaped portion for accommodating movements of said first panel during thermal expansion and a magnetic portion for providing a releasable seal between said bellows portion and said enclosure.

3. The assemblage recited in claim 2 wherein said magnetic portion comprises a magnet encased in a outer skin layer of said gasket.

4. The assemblage recited in claim 2 wherein said skin layer has a thickness in the range of about 0.017 inches to about 0.025 inches.

5. The assemblage recited in claim 2 further comprising means for restraining said first panel under overpressure from uncontrollable flight.

6. An assemblage according to claim 2 further comprising means for precisely positioning said first panel to said second panel surrounding said opening of said enclosure, said positioning means comprising at least one recess portion in said first panel, said recess portion being adapted for receiving a guide pin protruding from said enclosure or said second panel.

7. An assemblage according to claim 2 wherein said first panel has an inertial mass of less than about 2.5 pounds per square foot.

8. A method of relieving overpressure in an enclosure having an opening, said method comprising the steps of:

providing an assemblage comprising a first panel configured to surround an exterior side of said opening, said first panel comprising a thermal barrier layer for providing thermal insulation during normal operation, and panel edges surrounding said thermal barrier layer; a gasket member bonded to said thermal barrier layer adjacent to said panel edges, said gasket member comprising a bellows shaped portion for accommodating movements of said first panel during thermal expansion and a magnetic portion for providing a releasable seal between said bellows portion and said enclosure;

mounting said assemblage around said opening so that said magnetic portion of said first panel seals said opening of said enclosure, and releases said first panel in response to overpressure; and providing a second panel mounted to said enclosure around said opening for releaseably sealing said magnetic portion of said first panel thereto.

9. A method according to claim 8 further comprising the step of providing restraining means cooperatively joining said first panel and said enclosure to prevent uncontrolled flight of the first panel in response to overpressure.

10. A method according to claim 8 further comprising the step of providing restraining means cooperatively joining said first panel to said second panel to prevent uncontrolled flight of the first panel in response to an overpressure condition.

* * * * *

UNITED STATES PATENT AND TRADEMARK OFFICE

CERTIFICATE OF CORRECTION

PATENT NO. : 5,461,831
DATED : October 31, 1995
INVENTOR(S) : Vratislav M. Michal It is certified that error appears in the above-indentified patent and that said Letters Patent is hereby corrected as shown below:

Column 7, Line 18 should read --between said bellows portion and said second panel--.

Column 7, Line 22 should read --The assemblage recited in claim 3 wherein said skin--.

Signed and Sealed this

Twenty-third Day of January, 1996

*Attest:*

Bruce Lehman

BRUCE LEHMAN

*Attesting Officer*

*Commissioner of Patents and Trademarks*